US012687071B2

(12) United States Patent
Moyes

(10) Patent No.: US 12,687,071 B2
(45) Date of Patent: Jul. 21, 2026

(54) DOWNHOLE TORQUE REDUCER

(71) Applicant: Rotojar Innovations Limited, Dyce (GB)

(72) Inventor: Peter Barnes Moyes, Aberdeen (GB)

(73) Assignee: Rotojar Innovations Limited, Aberdeen (GB)

( * ) Notice: Subject to any disclaimer, the term of this patent is extended or adjusted under 35 U.S.C. 154(b) by 0 days.

(21) Appl. No.: 18/559,723

(22) PCT Filed: May 13, 2022

(86) PCT No.: PCT/EP2022/063038
§ 371 (c)(1),
(2) Date: Nov. 8, 2023

(87) PCT Pub. No.: WO2022/238562
PCT Pub. Date: Nov. 17, 2022

(65) Prior Publication Data

US 2024/0229560 A1 Jul. 11, 2024

(30) Foreign Application Priority Data

May 13, 2021 (GB) ..... 2106864

(51) Int. Cl.
*E21B 4/00* (2006.01)
*E21B 17/10* (2006.01)

(52) U.S. Cl.
CPC ..... *E21B 4/006* (2013.01); *E21B 17/1057* (2013.01); *E21B 17/1064* (2013.01)

(58) Field of Classification Search
CPC .. E21B 17/10; E21B 17/1064; E21B 17/1057; E21B 4/006
See application file for complete search history.

(56) References Cited

U.S. PATENT DOCUMENTS 4,606,417 A * 8/1986 Webb ..... E21B 7/10 175/325.3
5,711,386 A * 1/1998 Swietlik ..... E21B 17/1064 175/325.3

(Continued)

FOREIGN PATENT DOCUMENTS

EP 2446103 A2 5/2012
GB 2499953 A 9/2013

(Continued)

OTHER PUBLICATIONS

International Search Report and Written Opinion for International Application No. PCT/EP2022/063038 dated Sep. 9, 2022.

(Continued)

*Primary Examiner* — Yong-Suk (Philip) Ro

(74) *Attorney, Agent, or Firm* — Harness, Dickey & Pierce, P.L.C.

(57) ABSTRACT

A downhole torque reducer comprises a mandrel defining a circumferentially continuous inner bearing race and a bearing sleeve defining a circumferentially continuous outer bearing race, the bearing sleeve being mounted on the mandrel such that the outer bearing race of the bearing sleeve circumscribes the inner bearing race of the mandrel. A rolling bearing arrangement is radially interposed between the inner bearing race of the mandrel and the outer bearing race of the bearing sleeve to permit the bearing sleeve and the mandrel to be rotatable relative to each other.

22 Claims, 3 Drawing Sheets

(56) References Cited

U.S. PATENT DOCUMENTS

| | | | | |
|---|---|---|---|---|
| 5,833,018 | A | 11/1998 | von Gynz-Rekowski | |
| 6,655,477 | B2 * | 12/2003 | Appleton | E21B 17/046 166/241.6 |
| 10,851,589 | B2 * | 12/2020 | von Gynz-Rekowski | E21B 4/003 |
| 2016/0312534 | A1 | 10/2016 | Ficken | |

FOREIGN PATENT DOCUMENTS

| | | | |
|---|---|---|---|
| WO | WO-0159249 | A2 | 8/2001 |
| WO | WO-2019211588 | A1 | 11/2019 |
| WO | WO-2020212247 | A1 | 10/2020 |
| WO | WO-2022/129412 | A1 | 6/2022 |

OTHER PUBLICATIONS

Combined Search and Examination Report for British Application No. 2106864.8 dated Jan. 21, 2022.

Combined Search and Examination Report for British Application No. 2106864.8 dated Jul. 24, 2023.

International Preliminary Report on Patentability and Written Opinion dated Nov. 14, 2023, issued in corresponding International Application No. PCT/EP2022/0630383.

* cited by examiner

DOWNHOLE TORQUE REDUCER

CROSS-REFERENCE TO RELATED APPLICATIONS

This application is a national phase under 35 U.S.C. § 371 of PCT International Application No. PCT/EP2022/063038 which has an International filing date of May 13, 2022, which claims priority to Great Britian Application No. 2106864.8, filed May 13, 2021 the entire contents of each of which are hereby incorporated by reference.

FIELD

The present disclosure relates to a downhole torque reducer.

BACKGROUND

A requirement exists in the oil and gas wells construction process for a robust and reliable device to reduce the torque experienced whilst rotating the drill string within the wellbore by reducing the friction between the drill string and the wellbore itself. Friction between the drill string and the well bore can cause damage, such as wear in casing in cased hole sections, key-seating/washout/wear in open-hole sections and wear to the drill pipe itself. Use in open-hole can cause accelerated failure due to the aggressive nature of the wellbore conditions and heightened level of vibration causing loose components to break and/or fall-off.

Rotational friction causes a build-up in torque required from surface to rotate the drill string which is necessary to allow the drilling operation to be conducted. As such, energy transfer to the drill bit may be significantly hampered. Excess torque can be developed in wells with high deviation or horizontal sections such as in extended reach drilling (ERD) applications and can therefore limit the distance or depth of well to be drilled.

In well decommissioning operations where rotary jarring is required to pull out equipment from the wellbore, the high tensile loads may subject the drill string to high side loads in sections of build or curvature of the well bore. This can lead to similar wear and excess torque issues as described above.

Torque reducing devices are known to attempt to alleviate the problem, however there are a number of known problems with these existing devices. For example, clamshell designs are common where two halves of a sleeve are fitted around a mandrel and are bolted and/or pinned together. These pinned connections are weak and are prone to failure, resulting in components falling from the device. Further, clamshell designs often feature rolling elements which are held between the mandrel and the clamshell. The rolling elements are exposed to the joints of the clamshells whilst rotating causing an uneven running surface. More significantly, an un-evenly distributed load is applied to the rolling elements as the circular continuity of the hoop of the clamshell sleeve is broken. Furthermore the clamshell designs with rolling elements cannot be effectively sealed given the split nature of the design. This therefore allows well fluids and solids to enter the bearing causing rapid bearing failure.

SUMMARY

An aspect of the present disclosure relates to a downhole torque reducer comprising:

- a mandrel defining a circumferentially continuous inner bearing race;
- a bearing sleeve defining a circumferentially continuous outer bearing race, the bearing sleeve being mounted on the mandrel such that the outer bearing race of the bearing sleeve circumscribes the inner bearing race of the mandrel; and
- a rolling bearing arrangement radially interposed between the inner bearing race of the mandrel and the outer bearing race of the bearing sleeve to permit the bearing sleeve and the mandrel to be rotatable relative to each other.

During downhole use in a wellbore, engagement with a bore wall will cause the bearing sleeve to be rotationally held, with the rolling arrangement allowing the mandrel to more freely rotate relative to the held bearing sleeve. In this respect, the bearing sleeve substantially isolates the mandrel from drag torque interactions with the bore wall. The downhole torque reducer may be used in any downhole environment, for example in both cased/lined bores and open-hole bores. The bearing sleeve may thus be engaged with a bore wall in the form of an inner surface of a tubular (e.g., casing, liner etc.) and/or a bare rock face of an open-hole section.

As noted above, the inner and outer bearing races are circumferentially continuous. The term "circumferentially continuous" should be understood to mean unbroken or uninterrupted around the circumference. That is, the inner and outer bearing races do not include any seam, join, interface or the like which would otherwise be present where multiple separate components are joined together.

The provision of circumferentially continuous inner and outer bearing races may afford more stability and strength within both the mandrel and the bearing sleeve, minimising failure modes associated with clamshell type devices and their corresponding connection means. For example, the full hoop strength of the bearing sleeve and the mandrel may be retained. Furthermore, the continuous construction of the bearing races may provide continuous running surfaces for the roller bearing arrangement, resulting in more even load distribution within the rolling bearing arrangement. Also, the ability to provide a form of sealing between the mandrel and the bearing sleeve may be improved. An example of such sealing will be described below.

The bearing sleeve may define a unitary component. Similarly, the mandrel may define a unitary component. In some examples the provision of a component in unitary form may permit that component to be defined as a solid state component (e.g., solid state bearing sleeve and/or solid state mandrel).

Providing the bearing sleeve as a unitary component may provide a number of advantages, for example in terms of improved strength, facilitating better sealing of the rolling bearing arrangements and/or the like.

The mandrel may be configured to be connected to a rotating work string, such as a drill string (e.g., formed of drill pipe, drill collars etc.), rotary casing string (e.g., used in casing while drilling applications), prop shaft (e.g., from a motor) and/or the like. When the mandrel is connected to the work string the mandrel may be rotatable together with the work string. Thus, the torque reducer may function to minimise friction between the work string, when rotated, and the bore wall of a wellbore, thus effectively reducing drag torque experience by the work string. In some examples, when the mandrel is connected to a work string the mandrel may be considered to form part of the work string. Multiple downhole torque reducers as disclosed herein may be connected along a work string.

The mandrel may be configured to transmit axial loading, for example axial tensile and/or compressive loading, therealong. Such axial loading may be applied via the work string. The mandrel may be configured to transmit torque, for example torque applied by the work string. Axial loading and/or torque may be transmitted along the work string and the mandrel between a load source (e.g., rotary drive, hoisting system etc.) and downhole assembly, such as a bottom hole assembly (BHA), tool string, completion infrastructure, wellbore infrastructure and/or the like. The load source may be located topside in some examples. Alternatively, the load source may be located downhole, for example in the form of a motor, such as a mud motor.

In an example presented above the mandrel may be provided in unitary form. This may permit improved ability to transmit axial loading and/or torque.

The mandrel may comprise an end connector to facilitate connection to a work string. Such an end connector may comprise a threaded end connector, such as a pin/box type connector, premium threaded connector and/or the like. In some examples the mandrel may comprise opposite end connectors to permit the mandrel to be connected integrally and in-line within a work string. In this example the mandrel may form a joint within the work string.

The rolling bearing arrangement may comprise a plurality of rolling bodies radially interposed between the inner and outer bearing races. The rolling bodies may comprise one or more of rollers, balls, needles and/or the like. The rolling bearing arrangement may comprise a circumferential array of rolling bodies arranged between the inner and outer bearing races. The rolling bearing arrangement may comprise multiple (i.e., two, three, four etc.) axially distributed circumferential arrays of rolling bodies. Such axially distributed bearing arrays may provide for increased load bearing capability and allow for more stable support of the bearing sleeve about the mandrel.

At least one of the outer bearing race and inner bearing race may comprise a bearing raceway for axially captivating the rolling bearing arrangement. The bearing raceway may comprise or be defined by a circumferential groove. The circumferential groove may be configured to accommodate a circumferential array of rolling bodies. Where multiple circumferential arrays of rolling bodies are provided multiple bearing raceways (e.g., grooves) may be provided. In such an arrangement multiple bearing raceways may be axially distributed along the inner and/or outer bearing races.

In one example only one of the inner and outer bearing races comprises a bearing raceway. Such an arrangement may facilitate a degree of axial movement to be achieved between the mandrel and the bearing sleeve. This might minimise axial loading applied on the rolling bearing arrangement which may minimise rotational drag, increase operational longevity and the like.

In one example the inner bearing race defined by the mandrel may comprise one or more bearing raceways, for example in the form of one or more circumferential grooves, and the outer bearing race defined by the bearing sleeve may comprise a cylindrical bearing surface (i.e., without any bearing raceway such as a groove formed therein). This example may provide benefits in terms of allowing a thinner walled bearing sleeve to be utilised, in that additional wall thickness might not be necessary to accommodate the formation of one or more raceways. Such a configuration may reduce or prevent the rolling bearing arrangement from being subject to axial loads.

An inner diameter of the bearing sleeve may be sized to substantially correspond to an outer diameter of the rolling bearing arrangement. This may enable the bearing sleeve to be axially slid over the mandrel while the rolling bearing arrangement is located in situ on the mandrel.

Nevertheless, in an alternative example the outer bearing race defined by the bearing sleeve may comprise one or more bearing raceways, for example in the form of one or more circumferential grooves, and the inner bearing race defined by the mandrel may comprise a cylindrical bearing surface (i.e., without any bearing raceway such as a groove formed therein).

In a further example both the inner and outer bearing races may comprise one or more bearing raceways, for example in the form of one or more circumferential grooves. A bearing raceway on the inner bearing race may be axially aligned with a bearing raceway on the outer bearing surface to thus form a radially opposing raceway pair. In such an arrangement the rolling bearing arrangement will be received within the opposing raceway pairs and will thus function to axially lock the mandrel and the bearing sleeve together. In a further example, bearing raceways formed on the inner and outer bearing races may be axially misaligned (i.e., a bearing raceway may be aligned with an opposing cylindrical bearing surface). In other examples, a bearing cage, or a series of bearing cages, may be provided to retain the rolling bearing arrangement in place. The bearing cage may be provided in two or more parts. The two or more parts may permit the bearing cage to be mounted on, for example, the mandrel and assembled together.

The rolling bearing arrangement may comprise one or more rolling elements, such as rollers, balls, needles, etc. Where the rolling elements comprise one or more ball bearings, the ball bearings may be provided without the need for inner and/or outer bearing races. The rolling elements may comprise a specific number or quantity of ball bearings.

The downhole torque reducer may further comprise a bearing cavity defined between the mandrel and the bearing sleeve, wherein the rolling bearing arrangement is provided within the bearing cavity. The bearing cavity may be configured to be at least partially (incompletely or completely) filled with a lubricant, such as oil, grease and/or the like. While the term "lubricant" is used, this may provide a function other than lubrication, such as cooling, acting as a barrier medium to isolate the components within the bearing cavity from ambient fluids and debris, and/or the like. As such, the term "lubricant" may be interchangeable with the term "medium". The bearing cavity may be associated with a lubricant port for permitting lubricant to be delivered (e.g., injected) into the bearing cavity. The lubricant port may be formed in the bearing sleeve, for example extending through (e.g., radially through) a wall thickness of the bearing sleeve. The bearing cavity may be associated with a vent port for permitting fluid (e.g. air) to be vented from the bearing cavity. The vent port may be formed in the bearing sleeve, for example extending through (e.g., radially through) a wall thickness of the bearing sleeve. Such an arrangement may provide ease of access in that the lubricant port is readily accessible from the outer surface of the bearing sleeve. The lubricant port may be sealed or sealable with a plug or equivalent structure. The vent port may be sealed or sealable with a plug or equivalent structure.

The downhole torque reducer may comprise a pressure regulator for regulating the pressure within the bearing cavity. The pressure regulator may be configured to regulate the pressure within the bearing cavity with respect to a separate region, for example a region externally of the torque reducer, which might be defined by a wellbore region (e.g., annulus region) when in use. The pressure regulator may be configured to pressure balance the bearing cavity with respect to a separate region. The pressure regulator may be configured to accommodate thermal expansion and/or contraction of lubricant within the bearing cavity. The ability to regulate pressure within the bearing cavity may provide benefits such as reducing the risk of ingress or egress of material (fluids, debris etc.), providing safety measures to avoid high pressure decompression during or following retrieval, minimising the risk of deformation or other pressure induced damage to components due to high pressure differentials and/or the like.

In use, as the torque reducer is deployed deeper into a wellbore the ambient hydrostatic pressure will increase, wherein the pressure regulator may function to allow the bearing cavity to be maintained in pressure balance with the ambient hydrostatic pressure. As such, the pressure differential across any seals within the torque reducer may be minimised, which may facilitate improved sealing performance. When exposed to high hydrostatic (or other) pressures the risk of wellbore fluids entering the bearing cavity under pressure is minimised, thus minimising the effect such wellbore fluids might have on components within the bearing cavity. This pressure balance effect during use may also provide a similar benefit when the torque reducer is retrieved towards surface, in which case the hydrostatic pressure will reduce, such that the risk of lubricant being ejected under pressure is minimised.

The pressure regulator may comprise one or more moveable barriers forming a boundary of the bearing cavity. The pressure regulator may comprise a pressure transfer arrangement. The pressure regulator may comprise a piston, bellows, diaphragm and/or the like. In some examples, as described in more detail below, the pressure regulator may be incorporated within a sealing arrangement which functions to also seal the bearing cavity.

The downhole torque reducer may comprise a sealing arrangement for sealing the bearing cavity. Such sealing may protect the inner and outer bearing races and the rolling bearing arrangement from wellbore fluids and from any aggressive solid media or debris that may be present.

The sealing arrangement may be a dynamic sealing arrangement configured to provide a sealing function during relative rotation between the mandrel and the bearing sleeve. The sealing arrangement may operate in combination with a unitary bearing sleeve and mandrel to provide improved sealing, for example relative to known clamshell designs in that sealing across a split, join or seam is not required.

The sealing arrangement may be bi-directional. That is, the sealing arrangement may be configured to restrict both ingress and egress of material relative to the bearing cavity. For example, the sealing arrangement may be capable of providing sealing when exposed to a pressure differential in reverse directions.

The sealing arrangement may be configured to regulate pressure within the bearing cavity. That is, the sealing arrangement may provide a dual function of both sealing and pressure regulating the bearing cavity, thus avoiding the requirement for providing these different functions independently.

The sealing arrangement may accommodate volumetric changes within the bearing cavity, for example volumetric changes of a lubricant contained within the bearing cavity. Such volumetric changes may be as a result of thermal expansion and/or contraction of the lubricant within the bearing cavity, such that volumetric changes are accommodated without altering, or significantly altering the bearing cavity pressure, which might otherwise cause leakage past the sealing arrangement.

The sealing arrangement may facilitate pressure balancing of the bearing chamber with a separate region, for example a region externally of the torque reducer (e.g., a wellbore annulus region). The sealing arrangement may define a moveable barrier of the bearing cavity to allow pressure transference between the bearing cavity and the separate region.

The ability of the sealing arrangement to accommodate volumetric and/or pressure changes within the bearing cavity may provide for a more compact and less complex design, in that separate means to provide these functions may not be required. However, as disclosed herein, separate sealing and pressure regulating arrangements may be provided.

The sealing arrangement may comprise first and second seals positioned at opposing axial ends of the bearing cavity. In this example the sealing arrangement may define axial extremes of the bearing cavity.

At least one of the first and second seals may comprise one or more sealing components. At least one of the first and second seals may comprise a sealing member. The sealing member may be a bi-directional sealing member. The sealing member may be deformable and/or moveable, for example axially moveable, to accommodate volumetric changes within the bearing cavity, for example volumetric changes within a lubricant within the bearing cavity. This deformable and/or moveable capability of the sealing member may accommodate thermal expansion and contraction of a medium, such as a lubricant, contained within the bearing cavity. The deformable and/or moveable capability of the sealing member may facilitate pressure balancing of the bearing cavity with respect to an external location.

The sealing member may be formed of any material which suits the application. In some examples the sealing member may comprise a polymeric material, such as PTFE, an elastomer and/or the like.

Both the first and second seals may comprise a deformable and/or moveable seal member. This arrangement may maximise the volumetric change capabilities.

At least one of the first and second seals may comprise a wiper seal, for example a scarf cut wiper seal. The wiper seal may function in combination with a deformable and/or moveable seal member in order to ensure a clean sealing surface on one or both of the mandrel and bearing sleeve is maintained.

The bearing sleeve may be formed of a metallic material, although any other suitable material may be utilised. The bearing sleeve may be appropriately treated to facilitate improved longevity (e.g., wear resistance), accommodate improved sealing engagement with a sealing arrangement, accommodate improved running engagement with the rolling bearing arrangement and/or the like. The bearing sleeve may comprise hardened regions, honed/ground regions and/or the, for example on one or both of the inner bearing race and outer bore wall contacting structure.

The bearing sleeve may define a uniform wall thickness between opposing axial ends thereof. Alternatively, the bearing sleeve may comprise a varying wall thickness between opposing axial ends thereof. Such a varying wall thickness may be provided via variations in the outer surface of the bearing sleeve. In this example the inner surface of the bearing sleeve may comprise a constant or uniform profile. A varying wall thickness may provide benefits during use, such as providing regions of the bearing sleeve which may not come into contact with a bore wall, such as regions adjacent sealing structures. This may minimise lateral loading on such regions which may minimise radial loading imparted on the sealing structure.

The bearing sleeve may comprise a first axial region which accommodates engagement or is aligned with a sealing arrangement. That is, the first axial region may circumscribe a sealing arrangement. The bearing sleeve may comprise a second axial region which accommodates engagement or is aligned with the rolling bearing arrangement. That is, the second axial region may circumscribe the rolling bearing arrangement. In this example the second axial region may define the outer bearing race. In some examples the second axial region may define a greater outer dimension (i.e., gauge dimension) than the first region. This may minimise contact between the first region of the bearing sleeve and a bore wall, which may thus minimise radial forces imparted on the sealing arrangement.

The bearing sleeve may comprise a third axial region which accommodates engagement or is aligned with a sealing arrangement. In this example the first and third axial regions may circumscribe separate portions of a sealing arrangement. The second axial region may be interposed between the first and third axial regions. In some examples the second axial region may define a greater outer dimension (i.e., gauge dimension) than the third axial region.

The bearing sleeve may define an outer bore wall contacting structure. In some examples the outer bore wall contacting structure may be provided on the second region of the bearing sleeve, as defined above.

The outer bore wall contacting structure may comprise a cylindrical outer surface of the bearing sleeve. In some examples the outer bore wall contacting structure may comprise one or more protruding structures, such as ribs, vanes, fins, humps, posts, dimples and/or the like.

The bearing sleeve may be mounted on the mandrel by being axially slid over an end of the mandrel. Alternatively, the bearing sleeve may be directly formed or manufactured on the mandrel, for example using additive manufacturing (e.g., 3D printing) techniques. The bearing sleeve may be mounted, axially slid or formed on the mandrel after the rolling bearing arrangement has been located in situ on the mandrel. This may provide for certain advantages during the assembly of the downhole torque reducer.

The bearing sleeve may be axially positioned between first and second axial shoulders provided on the mandrel. In this respect the bearing sleeve may be held in place on the mandrel between the first and second axial shoulders. Such station keeping of the bearing sleeve may be such that the inner and outer bearing races are maintained in alignment. The torque reducer may comprise at least one bush member interposed between an axial end of the bearing sleeve and one or both of the first and second axial shoulders. The bush member may comprise a wear bush.

At least one of the first and second axial shoulders may be integrally formed with the mandrel. At least one of the first and second axial shoulders may be provided separately and secured to the mandrel. Such separate forming and mounting of at least one of the first and second load shoulders may permit the bearing sleeve to be slid onto one end of the mandrel during assembly.

At least one of the first and second axial shoulders may be provided via a separate tool component which is secured to the mandrel. That is, connecting of the torque reducer to a separate component may form at least one of the first and second axial shoulders.

At least one of the first and second axial shoulders may comprise or be formed on a retaining arrangement. The retaining arrangement may comprise a retaining ring, for example a unitary retaining ring. The retaining ring may be threadedly mounted on the mandrel. The torque reducer may comprise a torque shoulder, against which torque shoulder the retaining ring may be torqued. The torque shoulder may be formed directly on the mandrel. Alternatively, the torque shoulder may be formed on a separate component, such as a retaining mount, as described below.

In one example the mandrel may comprise a threaded portion for threaded engagement with the retaining ring.

The retaining arrangement may comprise a retaining mount configured to be mounted on the mandrel, wherein the retaining ring is configured to be mounted and secured on the retaining mount. In examples where the mandrel comprises an end connector the provision of a separate retaining mount may assist to allow the retaining arrangement to be axially set back form the end connector, which may assist to maximise the strength of the end connector. The retaining mount may define a connecting profile to facilitate connection with the retaining ring. The connecting profile may comprise a thread, for example a male thread, for threaded engagement with the retaining ring.

The retaining mount may be configured to be axially secured to the mandrel. For example, the retaining mount may comprise a radial extension configured for engagement with a radial slot within the mandrel. The retaining mount may be axially fixed to the mandrel via a suitable connection, such as a screw connection, pinned connection, keyed connection, welded connection and/or the like.

The retaining mount may be configured to be rotatably secured to the mandrel. Such an arrangement may allow torquing of the retaining ring onto the retaining mount via a threaded connection. The retaining mount may comprise an internal non-round profile configured to engage a non-round profile formed on an outer surface region of the mandrel. The retaining mount may be keyed, pinned or the like relative to the mandrel to provide a rotary connection.

The retaining mount may be generally ring shaped.

The retaining mount may be provided as a unitary component. Alternatively, the retaining mount may be provided in multiple components (i.e., two, three, four etc.) which are assembled together on the mandrel. The multiple components may comprise multiple circumferential segments. In one example the retaining mount may comprise a pair of segments. Providing the retaining mount in multiple segments may facilitate assembly. The retaining mount components may be secured relative to the mandrel, for example individually secured relative to the mandrel. Alternatively, or additionally, separate retaining mount components may be collectively held together on the mandrel by the retaining ring.

The retaining mount may comprise or define a torque shoulder, against which torque shoulder the retaining ring is torqued.

As noted above, the downhole torque reducer may be coupled to or within a rotating string. In some examples multiple torque reducers may be connected along a length of the string. A torque reducer may be located at any desired location along the length of the string. In some examples a downhole torque reducer may be located adjacent a bottom hole assembly (BHA) supported by the string.

As set out above, the mandrel defines an inner bearing race and the bearing sleeve defines and outer bearing race. The inner and outer races may be integrally formed with the mandrel and bearing sleeve, respectively. Alternatively, one or both of the inner and outer races may be provided on a separate component.

In some examples the downhole torque reducer may be defined without reference to inner and outer races. For example, in substitution for the inner race the mandrel may be defined as including an outer bearing structure, and in substitution for the outer race the bearing sleeve may be defined as including an inner bearing structure.

An aspect of the present disclosure relates to a downhole torque reducer comprising:

- a mandrel defining a circumferentially continuous outer bearing structure;
- a bearing sleeve defining a circumferentially continuous inner bearing structure, the bearing sleeve being mounted on the mandrel such that the inner bearing structure of the bearing sleeve circumscribes the outer bearing structure of the mandrel; and
- a rolling bearing arrangement radially interposed between the inner and outer bearing structures to permit the bearing sleeve and the mandrel to be rotatable relative to each other.

An aspect of the present disclosure related to a method for reducing torque in a downhole rotating string using a downhole torque reducer according to any other aspect.

An aspect of the present disclosure relates to a downhole rotating string comprising at least one torque reducer according to any other aspect.

The downhole torque reducer or any aspect defined herein, or any individual component or groups of components, may be manufactured in any suitable manner. In some examples the disclosed downhole torque reducer, or any individual component or groups of components may be manufactured by additive manufacturing. Such described additive manufacturing typically involves processes in which components are fabricated based on three-dimensional (3D) information, for example a three-dimensional computer model (or design file), of the component.

Accordingly, examples described herein not only include the downhole torque reducer and associated components, but also methods of manufacturing the downhole torque reducer or associated components via additive manufacturing and computer software, firmware or hardware for controlling the manufacture of the downhole torque reducer and associated components via additive manufacturing. All future reference to "product" are understood to include the described torque reducer and all associated components.

The structure of the product may be represented digitally in the form of a design file. A design file, or computer aided design (CAD) file, is a configuration file that encodes one or more of the surface or volumetric configuration of the shape of the product. That is, a design file represents the geometrical arrangement or shape of the product.

Design files may take any now known or later developed file format. For example, design files may be in the Stereolithography or "Standard Tessellation Language" (.stl) format which was created for stereolithography CAD programs of 3D Systems, or the Additive Manufacturing File (.amf) format, which is an American Society of Mechanical Engineers (ASME) standard that is an extensible markup-language (XML) based format designed to allow any CAD software to describe the shape and composition of any three-dimensional object to be fabricated on any additive manufacturing printer.

Further examples of design file formats include AutoCAD (.dwg) files, Blender (.blend) files, Parasolid (.x_t) files, 3D Manufacturing Format (0.3 mf) files, Autodesk (3ds) files, Collada (.dae) files and Wavefront (.obj) files, although many other file formats exist.

Design files may be produced using modelling (e.g. CAD modelling) software and/or through scanning the surface of a product to measure the surface configuration of the product.

Once obtained, a design file may be converted into a set of computer executable instructions that, once executed by a processer, cause the processor to control an additive manufacturing apparatus to produce a product according to the geometrical arrangement specified in the design file. The conversion may convert the design file into slices or layers that are to be formed sequentially by the additive manufacturing apparatus. The instructions (otherwise known as geometric code or "G-code") may be calibrated to the specific additive manufacturing apparatus and may specify the precise location and amount of material that is to be formed at each stage in the manufacturing process. The formation may be through deposition, through sintering, or through any other form of additive manufacturing method.

The code or instructions may be translated between different formats, converted into a set of data signals and transmitted, received as a set of data signals and converted to code, stored, etc., as necessary. The instructions may be an input to the additive manufacturing system and may come from a part designer, an intellectual property (IP) provider, a design company, the operator or owner of the additive manufacturing system, or from other sources. An additive manufacturing system may execute the instructions to fabricate the product using any of the technologies or methods disclosed herein.

Design files or computer executable instructions may be stored in a (transitory or non-transitory) computer readable storage medium (e.g., memory, storage system, etc.) storing code, or computer readable instructions, representative of the product to be produced. As noted, the code or computer readable instructions defining the product that may be used to physically generate the object, upon execution of the code or instructions by an additive manufacturing system. For example, the instructions may include a precisely defined 3D model of the product and may be generated from any of a large variety of well-known computer aided design (CAD) software systems such as AutoCAD®, TurboCAD®, DesignCAD 3D Max, etc. Alternatively, a model or prototype of the component may be scanned to determine the three-dimensional information of the component.

Accordingly, by controlling an additive manufacturing apparatus according to the computer executable instructions, the additive manufacturing apparatus may be instructed to print out the product.

In light of the above, embodiments include methods of manufacture via additive manufacturing. This includes the steps of obtaining a design file representing the product and instructing an additive manufacturing apparatus to manufacture the product in assembled or unassembled form according to the design file. The additive manufacturing apparatus may include a processor that is configured to automatically convert the design file into computer executable instructions for controlling the manufacture of the product. In these embodiments, the design file itself may automatically cause the production of the product once input into the additive manufacturing device. Accordingly, in this embodiment, the design file itself may be considered computer executable instructions that cause the additive manufacturing apparatus to manufacture the product. Alternatively, the design file may be converted into instructions by an external computing system, with the resulting computer executable instructions being provided to the additive manufacturing device.

Given the above, the design and manufacture of implementations of the subject matter and the operations described in this specification may be realised using digital electronic circuitry, or in computer software, firmware, or hardware, including the structures disclosed in this specification and their structural equivalents, or in combinations of one or more of them. For instance, hardware may include processors, microprocessors, electronic circuitry, electronic components, integrated circuits, etc. Implementations of the subject matter described in this disclosure may be realised using one or more computer programs, i.e., one or more modules of computer program instructions, encoded on computer storage medium for execution by, or to control the operation of, data processing apparatus. Alternatively or in addition, the program instructions may be encoded on an artificially generated propagated signal, e.g., a machine-generated electrical, optical, or electromagnetic signal that is generated to encode information for transmission to suitable receiver apparatus for execution by a data processing apparatus. A computer storage medium may be, or be included in, a computer-readable storage device, a computer-readable storage substrate, a random or serial access memory array or device, or a combination of one or more of them. Moreover, while a computer storage medium is not a propagated signal, a computer storage medium may be a source or destination of computer program instructions encoded in an artificially generated propagated signal. The computer storage medium may also be, or be included in, one or more separate physical components or media (e.g., multiple CDs, disks, or other storage devices).

Although additive manufacturing technology is described herein as enabling fabrication of complex objects by building objects point-by-point, layer-by-layer, typically in a vertical direction, other methods of fabrication are possible and within the scope of the present subject matter. For example, although the discussion herein refers to the addition of material to form successive layers, one skilled in the art will appreciate that the methods and structures disclosed herein may be practiced with any additive manufacturing technique or other manufacturing technology.

Another aspect of the present disclosure relates to a computer program comprising computer executable instructions that, when executed by a processor, cause the processor to control an additive manufacturing apparatus to manufacture the described downhole torque reducer.

Another aspect of the present disclosure relates to a method of manufacturing a downhole torque reducer or a component thereof via additive manufacturing, the method comprising:

- obtaining an electronic file representing a geometry of the described downhole torque reducer or component thereof; and
- controlling an additive manufacturing apparatus to manufacture, over one or more additive manufacturing steps, the downhole torque reducer or component thereof according to the geometry specified in the electronic file.

Aspects of the disclosure described may include one or more examples, embodiments or features in isolation or in various combinations whether or not specifically stated (including claimed) in that combination or in isolation.

BRIEF DESCRIPTION OF THE DRAWINGS

These and other aspects of the present disclosure will now be described, by way of example only, with reference to the accompanying drawings, in which.

DETAILED DESCRIPTION OF THE DRAWINGS

Figure 1:
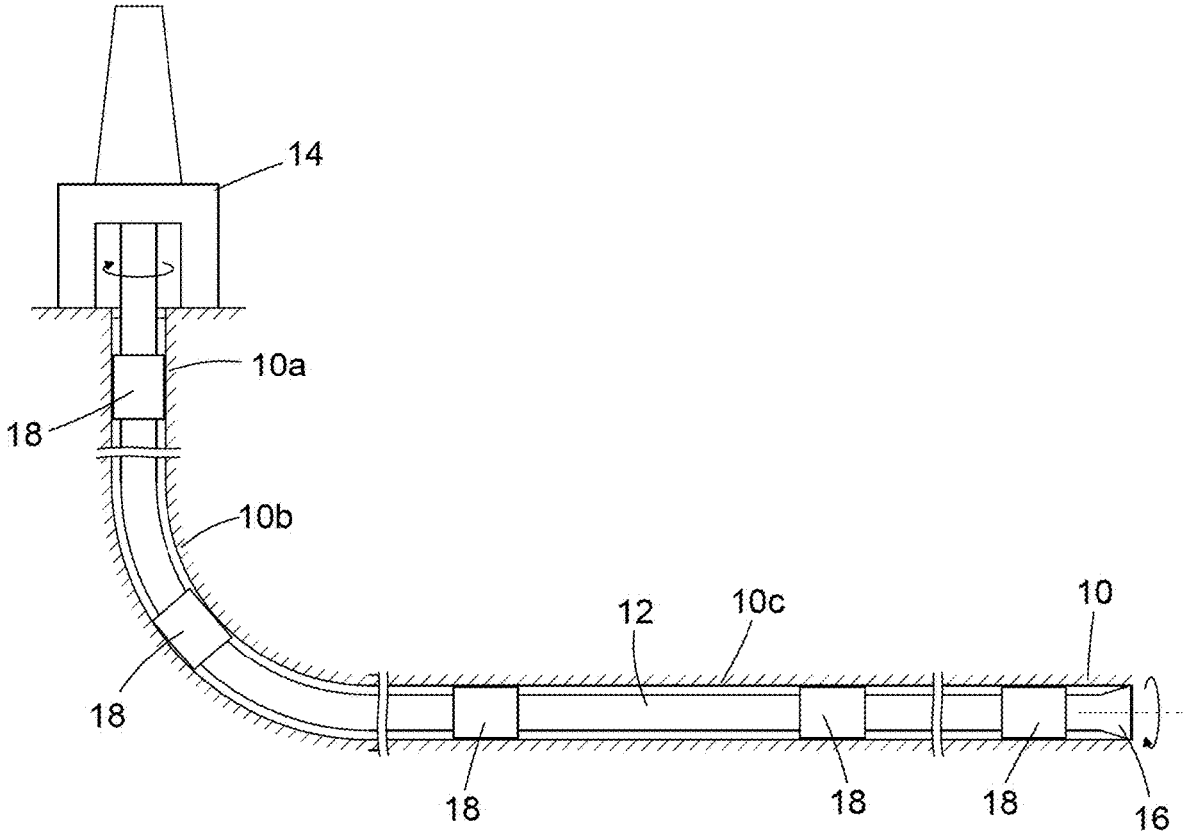
FIG. 1 is a diagrammatic illustration of a well bore under construction using a drill string which includes multiple downhole torque reducers.

FIG. 1 diagrammatically illustrates a well bore 10 under construction using a drill string 12 which is rotated and advanced from a drilling rig 14 located at surface. The drilling rig 14 may be of any suitable form, including a land based rig, offshore rig such as a jack up, a semi-submersible platform, a drillship and/or the like. In the present example the well bore 10 is a deviated bore which includes a vertical bore section 10*a*, a build-up section 10*b* and a horizontal section 10*c*. However, the present disclosure extends to any form of well bore. Further, although not illustrated the well bore 10, in some sections, may be cased or lined, with or without cementing.

The drill string 12 may be formed of multiple jointed drill pipe and collars and includes a drilling bottom hole assembly (BHA) 16 which may incorporate conventional equipment such as a drill bit, stabilisers, measurement while drilling (MWD) equipment, directional drilling equipment and/or the like. Although not separately illustrated the drill string 12 and/or BHA may comprise or be connected with a jarring or percussive hammer tool or apparatus. Such a jarring or percussive hammer tool may be used to assist the rate of penetration. Further, such a jarring or percussive hammer tool may be operated in response to rotation of the drill string 12.

The drill string 12 further includes multiple torque reducers 18 distributed along its length. As will be described in detail below, the torque reducers 18 function to minimise friction between the drill string 12 and the wall of the well bore 10 (which may be open-hole or cased/lined), to thus maximise energy transfer between the drilling rig 14 and the drilling BHA 16. This may in turn reduce the drive torque requirements at the surface. The reduced friction effect may be of particular benefit in the build-up and horizontal sections 10*a*, 10*c* of the wellbore, and may permit further extended reach well bores to be formed.

Figure 2:
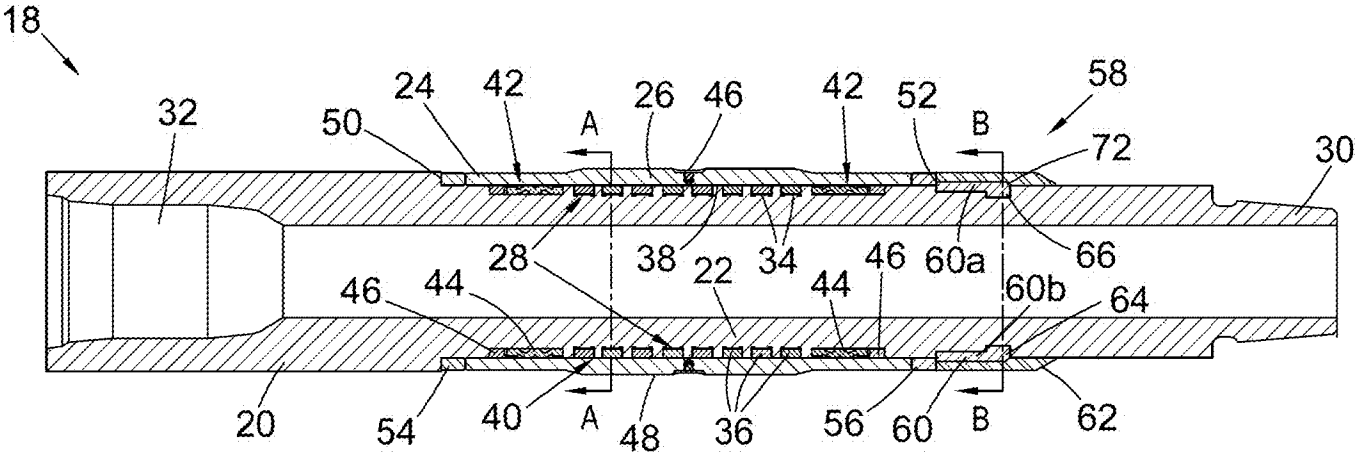
FIG. 2 is a longitudinal cross-sectional view of a downhole torque reducer.

A longitudinal cross-sectional view of a torque reducer 18 used in the example of FIG. 1 is illustrated in FIG. 2. The torque reducer 18 includes a mandrel 20 which defines an inner bearing race 22, and a bearing sleeve 24 which defines a corresponding outer bearing race 26, wherein the bearing sleeve 24 is mounted around the mandrel 20 such that the inner and outer bearing races 22, 26 are aligned. A rolling bearing arrangement 28 radially interposed between the mandrel 20 and the bearing sleeve 22 to permit relative rotation therebetween.

The mandrel 20 includes opposing end connectors 30, 32 (in the form of pin and box type connectors) for facilitating connection to the drill string 12 (FIG. 1).

During use in the well bore 10 (FIG. 1), engagement with the bore wall will cause the bearing sleeve 24 to be rotationally held, with the rolling bearing arrangement 28 allowing the mandrel 20 to more freely rotate relative to the held bearing sleeve 24. In this respect, the bearing sleeve 24 substantially isolates the mandrel 20 and the connected string 12 from drag torque interactions with the bore wall.

In this example the mandrel 20 and bearing sleeve 24 are each of unitary construction such that the inner and outer bearing races 22, 26 are circumferentially continuous. However, it should be recognised that in some examples the mandrel and/or bearing sleeve may be formed of multiple connected components while still allowing the bearing races 22, 26 to be circumferentially continuous. For example, one or both of the mandrel 20 and the bearing sleeve 26 may comprise separate interconnected axial portions, wherein the inner and/or outer bearing races 22, 26 are defined by a unitary axial component.

The provision of circumferentially continuous inner and outer bearing races 22, 26 may afford more stability and strength within both the mandrel 20 and the bearing sleeve 24, minimising failure modes associated with clamshell type devices and their corresponding connection means. For example, the full hoop strength of the bearing sleeve 24 and the mandrel 20 may be retained. Furthermore, the continuous construction of the bearing races 22, 26 may provide continuous running surfaces for the rolling bearing arrangement 28, resulting in more even load distribution. Also, the ability to provide a form of sealing between the mandrel 20 and the bearing sleeve 24, as described below, may be improved.

Figure 3:
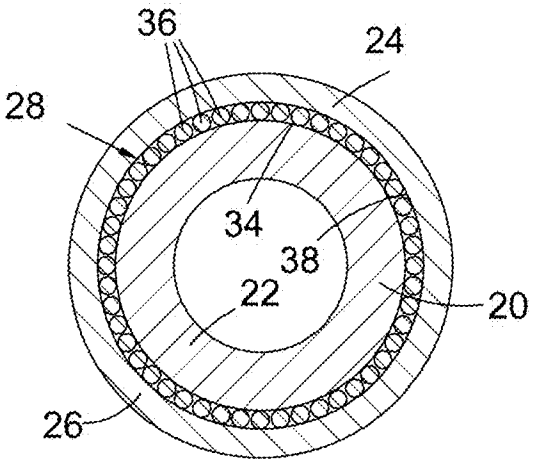
FIG. 3 is a lateral cross-sectional view of the torque reducer of FIG. 2, taken along line A-A.

In the present example the inner bearing race 22 formed by the mandrel 20 comprises a plurality of axially arranged bearing raceways in the form of circumferential grooves 34. The rolling bearing arrangement 28 comprises a plurality of rolling elements 36 (e.g., rollers, balls, needles etc.) located within each circumferential groove 34, such that a plurality of circumferential arrays of rolling elements 36 is provided, with one circumferential array illustrated in FIG. 3, which is a lateral sectional view of FIG. 2 taken along line A-A. Such axially distributed arrays of rolling elements 36 may provide for increased load bearing capability and allow for more stable support of the bearing sleeve 26 about the mandrel 20.

The outer bearing race 26 formed by the bearing sleeve 26 does not include any bearing raceway but rather a cylindrical bearing surface 38, along which the rolling elements 36 may roll. This arrangement may permit a thinner walled bearing sleeve 24 to be provided, in that additional wall thickness to accommodate the formation of one or more raceways therein is not required. Further, by providing the raceway grooves 34 only in the inner bearing race 22 a degree of axial movement may be achieved between the mandrel 20 and the bearing sleeve 24. This might minimise axial loading applied on the rolling bearing elements 36 which may minimise rotational drag, increase operational longevity and the like.

A bearing cavity 40 is formed between the mandrel 20, bearing sleeve 24 and first and second axial seals 42, such that the rolling bearing arrangement 28 is provided within the bearing cavity. The bearing cavity 40 is configured to be at least partially (incompletely or completely) filled with a lubricant, such as oil, grease and/or the like. The bearing sleeve 24 comprises one or more lubricant ports 46 extending from an outer surface thereof to facilitate delivery (e.g., injection) of lubricant into the bearing cavity 40. The lubricant port(s) 46 may be sealed or sealable with a plug or equivalent structure.

In the present example the first and second seals 42 are the same, although this need not be the case. The first and second seals 42 each comprise a sealing member 44, which may have bi-directional sealing capabilities. The sealing members 44 are deformable and/or moveable, for example axially moveable, to accommodate volumetric changes of the lubricant within the bearing cavity 40 which may be caused by thermal expansion and contraction. By virtue of both the first and second seals 42 having deformable and/or moveable sealing members 44 the volumetric changes which can be accommodated may be maximised.

The deformable and/or moveable capability of the sealing members 44 also facilitates pressure balancing of the bearing cavity 40 with respect to an external location, such as an annulus region within a well bore. Such pressure balancing may be achieved by virtue of the sealing members 44 being in pressure communication with both the bearing cavity 40 and the external region. In use, as the torque reducer 18 is deployed deeper into a well bore the ambient hydrostatic pressure will increase, wherein the sealing members 40 function to allow the bearing cavity 40 to be maintained in pressure balance with the ambient hydrostatic pressure. As such, the pressure differential across the seals 42 may be minimised, which may facilitate improved sealing performance. When exposed to high hydrostatic (or other) pressures the risk of wellbore fluids entering the bearing cavity 40 under pressure is minimised, thus minimising the effect such wellbore fluids might have on components within the bearing cavity 40. This pressure balance effect during use may also provide a similar benefit when the torque reducer 18 is retrieved towards surface, in which case the hydrostatic pressure will reduce, such that the risk of lubricant being ejected under pressure is minimised.

The sealing members 44 may be formed of any material which suits the application. In some examples the sealing members 42 may comprise a polymeric material, such as PTFE, an elastomer and/or the like.

The first and second seals 42 each further comprise a wiper seal 46, for example a scarf cut wiper seal, adjacent an outer side (relative to the bearing cavity 40) of the associated sealing members 44. The wiper seals 46 may function in combination with the sealing members 44 in order to ensure a clean sealing surfaces on the mandrel 20 and bearing sleeve 24 are maintained.

In the present example the bearing sleeve 24 comprises a varying wall thickness between opposing axial ends thereof, wherein such a varying wall thickness is provided via variations in the outer surface of the bearing sleeve 24 such that the inner surface of the bearing sleeve 24 may comprise a constant or uniform profile. More specifically, a central axial region of the bearing sleeve 24 defines a region of increased wall thickness relative to the axial end regions such that the central region defines the maximum outer gauge diameter of the torque reducer 18. As such, this central region may define a bore wall engaging surface 48 which engages a bore wall during use. Further, this central region also circumscribes the rolling bearing arrangement 28 such that the thicker wall section has increased load bearing capacity.

The thinner walled axial end regions of the bearing sleeve 24 are aligned with the first and second seals 42. That is, the thinner walled axial end regions circumscribe the first and second seals 42. These thinner walled end regions are less likely to engage a bore wall (in view of the thicker central region) such that radial forces imparted on the seals 42 may be minimised.

The bearing sleeve 24 is located and held in place between first and second axial shoulders 50, 52 provided on the mandrel 20, wherein a wear bush 54, 56 is interposed between the axial ends of the bearing sleeve 24 and a respective axial shoulder 50, 52.

In the present example the first axial shoulder 50 is integrally formed on the mandrel via an annular stepped profile, whereas the second axial shoulder 52 is separately formed and securable on the mandrel 20. Such an arrangement may permit the bearing sleeve 24 to be slid over an end of the mandrel 20 (over connector 30) with the second axial load shoulder 52 subsequently being installed to retain the bearing sleeve 24 in place. Furthermore, an inner diameter of the bearing sleeve 24 may be sized to substantially correspond to an outer diameter of the rolling bearing arrangement 28, which permits the bearing sleeve 24 to be axially slid over the mandrel 20 while the rolling bearing arrangement 28 is located in situ on the mandrel 20. However, in other examples the second axial load shoulder may also be integrally formed with the mandrel. For example, some or all of the torque reducer 18 may be formed by additive manufacturing techniques.

Figure 4:
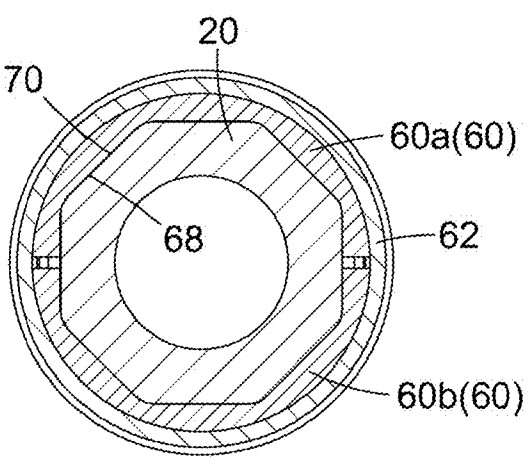
FIG. 4 is a lateral cross-sectional view of the torque reducer of FIG. 2, taken along lone B-B.

The second load shoulder comprises or is formed on a retaining arrangement 58 which includes a retaining mount 60 axially and rotatably secured to the mandrel 20, and a retaining ring 62 threadedly secured over the retaining mount 60. Referring additionally to FIG. 4, which is a lateral cross-sectional view of FIG. 2 taken along line B-B, the retaining mount is formed of two half segments 60*a*, 60*b* which can be mounted around the outer surface of the mandrel 20 to form a mounting ring structure. The retaining mount segments 60*a*, 60*b* each include a radial tab portion 64 which are received within a circumferential groove 66 formed in an outer surface of the mandrel 20 in order to axially fix the segments 60*a*, 60*b* to the mandrel 20. The retaining mount segments 60*a*, 60*b* also collectively define a faceted or non-round internal profile 68 which is mounted on a corresponding faceted or non-round outer profile 70 on a portion of the mandrel 20, to thus allow the segments 60*a*, 60*b* of the retaining mount 60 to be rotatably secured to the mandrel 20.

The retaining mount segments 60*a*, 60*b* collectively define an outer threaded surface of the retaining mount 60 which is engaged by an inner threaded surface of the retaining ring 62, wherein the retaining ring 62, once threaded onto the retaining mount 60 functions to retain the retaining mount segments 60*a*, 60*b* on the mandrel 20. The retaining mount segments 60*a*, 60*b* also collectively define a torque shoulder 72 against which the retaining ring may be torqued or tightened.

Figure 5:
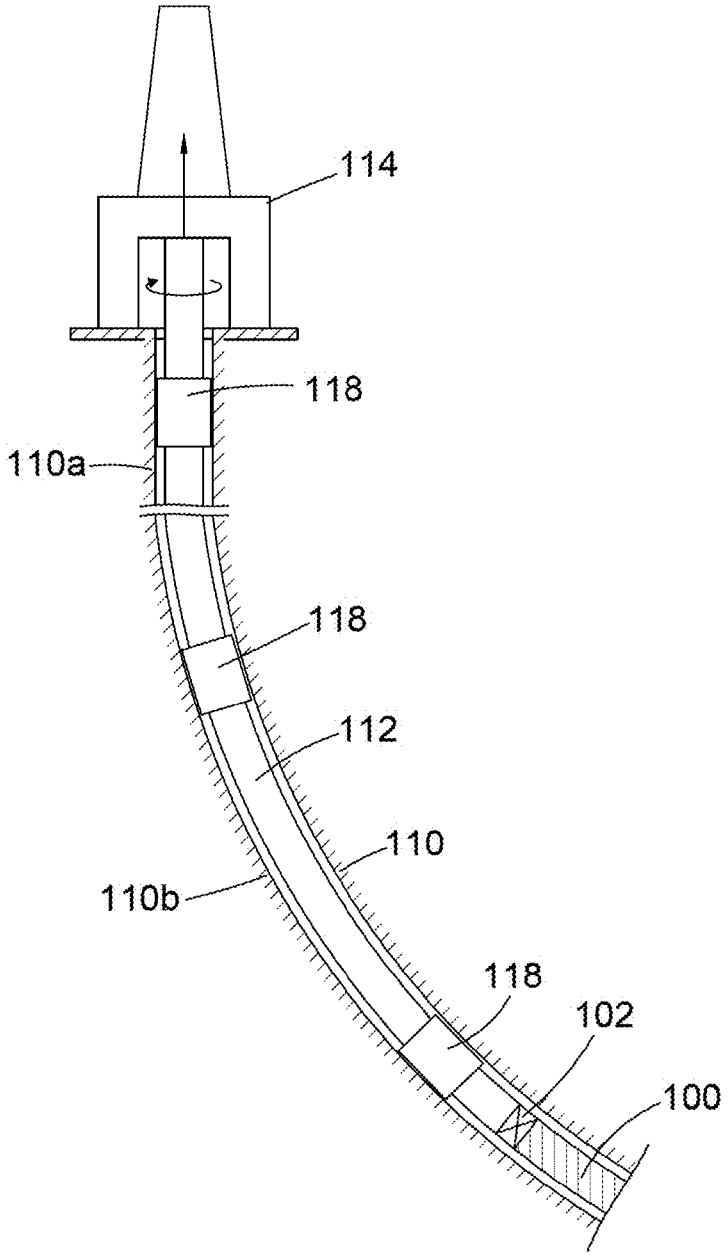
FIG. 5 is a diagrammatic illustration of a downhole operation in which equipment is being removed from a wellbore utilising a rotating string which incorporates multiple torque reducers.

In the example presented above multiple downhole torque reducers 18 as disclosed herein are provided on a drill string during the drilling of a well bore. However, downhole torque reducers 18 as disclosed herein may be used in any downhole application to reduce friction between a rotating body (e.g., any rotating string) and a bore wall. One further example application is illustrated in FIG. 5 which diagrammatically illustrates the removal of apparatus 100 (e.g., casing, liner, completion infrastructure etc.) from a well bore 110 (for example during decommissioning) using a rotating string 112 (which may be formed of jointed drill pipe, for example) and associated rig 114. The rotating string 112 may be required for many reasons, for example to rotate the apparatus 100 to aid in removal. However, for the purposes of the present example the rotating string 112 is utilised to operate a rotary jarring tool 102 to apply jarring forces to the apparatus 100 to aid in removal.

In this example the wellbore 110 includes a curved build-up or deviated section 110*b* which transitions to an upper vertical section 110*a*. The tension applied on the rotating string 112 by the rig 114 may generate high side loads in the curved build-up section 110*b* which could lead to similar wear and excess torque issues described previously. To address this multiple torque reducers 118 according to the present disclosure are distributed along the length of the rotating string 112, thus minimising friction between the rotating string and the wall of the well bore 110. The torque reducers 118 may be similar to torque reducers 18 and as such no further description will be given.

It should be understood that the examples presented herein are indeed exemplary and that various modifications may be made thereto without departing from the scope of the claims.

The invention claimed is:

1. A downhole torque reducer comprising:

a mandrel defining a circumferentially continuous inner bearing race;

a bearing sleeve defining a circumferentially continuous outer bearing race, the bearing sleeve being mounted on the mandrel such that the outer bearing race of the bearing sleeve circumscribes the inner bearing race of the mandrel, wherein the mandrel and the bearing sleeve are arranged concentrically; and a rolling bearing arrangement radially interposed between the inner bearing race of the mandrel and the outer bearing race of the bearing sleeve to permit the bearing sleeve and the mandrel to be rotatable relative to each other.

2. The downhole torque reducer according to claim 1, wherein the mandrel comprises one or more end connectors to permit connection with a rotating string.

3. The downhole torque reducer according to claim 1, wherein the rolling bearing arrangement comprises a plurality of rolling bodies radially interposed between the inner and outer bearing races.

4. The downhole torque reducer according to claim 3, wherein the rolling bearing arrangement comprises at least one circumferential array of rolling bodies arranged between the inner and outer bearing races.

5. The downhole torque reducer according to claim 1, wherein at least one of the outer bearing race and inner bearing race comprises a bearing raceway for axially captivating the rolling bearing arrangement.

6. The downhole torque reducer according to claim 1, wherein the inner bearing race comprises at least one bearing raceway and the outer bearing race comprises a cylindrical bearing surface.

7. The downhole torque reducer according to claim 1, comprising a bearing cavity defined between the mandrel and the bearing sleeve, wherein the rolling bearing arrangement is provided within the bearing cavity.

8. The downhole torque reducer according to claim 7, comprising a pressure regulator for regulating a pressure within the bearing cavity with respect to a separate region externally of the downhole torque reducer.

9. The downhole torque reducer according to claim 7, comprising a sealing arrangement for sealing the bearing cavity.

10. The downhole torque reducer according to claim 9, wherein the sealing arrangement is configured to at least one of accommodate thermal expansion and contraction within the bearing cavity and regulate pressure within the bearing cavity with respect to a separate region externally of the downhole torque reducer.

11. The downhole torque reducer according to claim 9, wherein the sealing arrangement comprises first and second seals positioned at opposing axial ends of the bearing cavity.

12. The downhole torque reducer according to claim 11, wherein at least one of the first and second seals comprises at least one of a deformable and moveable sealing member.

13. The downhole torque reducer according to claim 11, wherein at least one of the first and second seals comprises a wiper seal.

14. The downhole torque reducer according to claim 1, wherein the bearing sleeve defines a central region which defines an outer gauge diameter of the downhole torque reducer, and axial end regions which define a smaller diameter than the central region.

15. The downhole torque reducer according to claim 14, comprising a sealing arrangement for sealing a bearing cavity, the sealing arrangement comprising first and second seals positioned at opposing axial ends of the bearing cavity, wherein the axial end regions circumscribe the first and second seals.

16. The downhole torque reducer according to claim 1, wherein the bearing sleeve is axially positioned between first and second axial shoulders provided on the mandrel.

17. The downhole torque reducer according to claim 16, wherein at least one of:

at least one of the first and second axial shoulders is integrally formed with the mandrel; and at least one of the first and second axial shoulders is provided separately and secured to the mandrel.

18. The downhole torque reducer according to claim 16, wherein at least one of the first and second axial shoulders is formed on a retaining arrangement.

19. The downhole torque reducer according to claim 18, wherein the retaining arrangement comprises a retaining ring mounted on the mandrel.

20. The downhole torque reducer according to claim 19, wherein the retaining arrangement comprises a retaining mount mounted on the mandrel, wherein the retaining ring is mounted and secured on the retaining mount.

21. The downhole torque reducer according to claim 20, wherein the retaining mount is axially and rotatably securable to the mandrel.

22. The downhole torque reducer according to claim 20, wherein the retaining mount comprises multiple components which are assembled together on the mandrel.

* * * * *